US009459075B1

(12) United States Patent
Hatcher

(10) Patent No.: US 9,459,075 B1
(45) Date of Patent: Oct. 4, 2016

(54) ELEVATED SIGHT

(71) Applicant: ARMSON INTERNATIONAL, LLC, Westbrook, ME (US)

(72) Inventor: Forest A. Hatcher, Gray, ME (US)

(73) Assignee: Rapid Entry Technologies, LLC, Maryville, TN (US)

( * ) Notice: Subject to any disclaimer, the term of this patent is extended or adjusted under 35 U.S.C. 154(b) by 57 days.

(21) Appl. No.: 14/266,401

(22) Filed: Apr. 30, 2014

Related U.S. Application Data

(60) Provisional application No. 61/817,531, filed on Apr. 30, 2013.

(51) Int. Cl.
*F41G 1/16* (2006.01)
*F41G 1/38* (2006.01)
*F41G 1/48* (2006.01)

(52) U.S. Cl.
CPC . *F41G 1/16* (2013.01); *F41G 1/38* (2013.01); *F41G 1/48* (2013.01)

(58) Field of Classification Search
CPC ..... F41G 1/16
USPC ..... 42/125, 126, 136, 138, 105, 128; 89/41.17
See application file for complete search history.

(56) References Cited

U.S. PATENT DOCUMENTS 4,317,304 A * 3/1982 Bass ..... F41G 11/001 42/125
6,591,538 B2 * 7/2003 Holler ..... F41G 11/007 42/125
6,662,486 B2 * 12/2003 Komberger ..... F41G 11/007 42/135

OTHER PUBLICATIONS

Milkor Ltd. South Africa Company Profile, www.milkor.net, 2012, 7 pgs.

* cited by examiner

*Primary Examiner* — Reginald Tillman, Jr.
(74) *Attorney, Agent, or Firm* — Matthew M. Googe; Robinson IP Law, PLLC

(57) ABSTRACT

An adjustable occluded eye sight for use with multiple types of weapons including guns and projectile launchers. The sight being light weight, having a low profile, and mountable on the top of a weapon and adjustable for different launch angles.

18 Claims, 7 Drawing Sheets

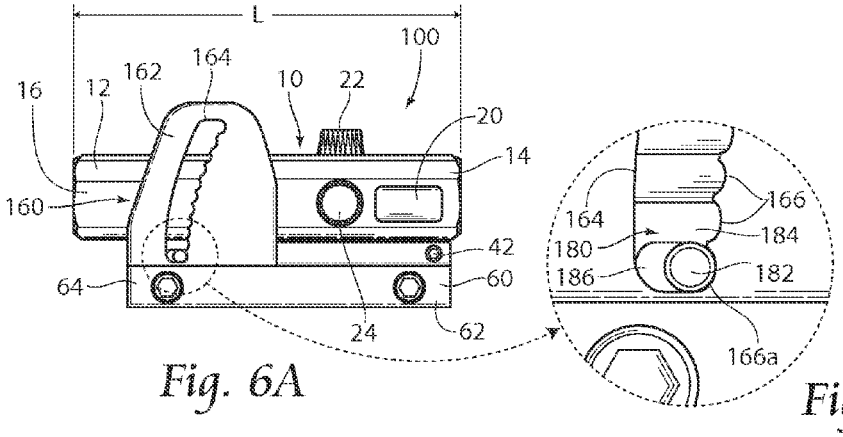
Fig. 6A
Fig. 6B
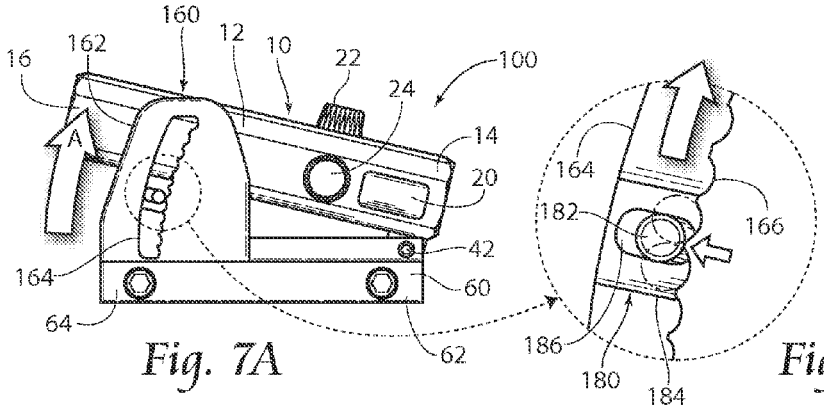
Fig. 7A
Fig. 7B
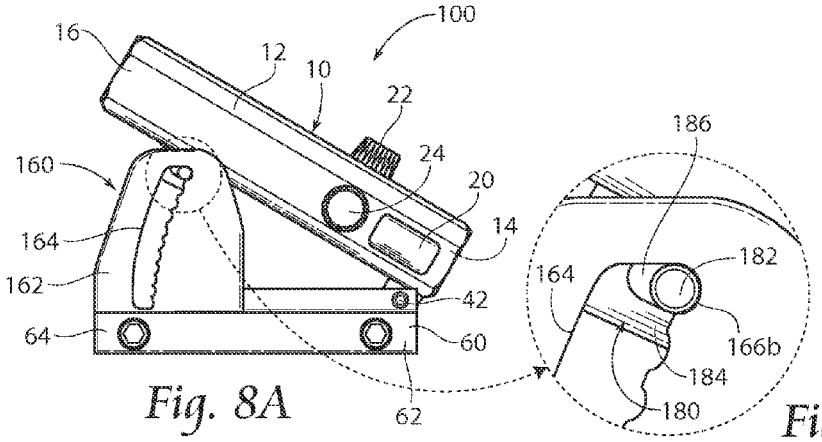
Fig. 8A
Fig. 8B

ELEVATED SIGHT

RELATED APPLICATIONS

This application claims the benefit of U.S. Provisional Patent Application Ser. No. 61/817,531, filed on 30 Apr. 2013.

BACKGROUND OF THE INVENTION

Sighting equipment, such as sights used with weapons, more specifically guns or other types of projectile launchers, are well know to those in the art. Accuracy, consistency, and ease-of-use are three of the hallmarks of a quality sight. Over the years many different types of sights have been designed and manufactured in an attempt to provide a user with evermore practicality and functionality.

For example, one the oldest types of sight is the iron sight. It comprises two spaced metal aiming points that have to be aligned. This type of sight requires considerable experience and skill because a user must hold a proper eye position while simultaneously focusing on the rear sight, the front sight, and a target at different distances in order to align all three in order to hit a target. Another type of sight is a telescopic sight. As the name implies, telescopic sights provide the user with an enhanced view of a target through the scope. Telescopic sights allow for greater accuracy at long distances but at the cost of peripheral vision, as the user will tend to close the non-dominant eye. Yet another sight is the reflector sight. Reflector sights generally comprise a reticule of some type and a lens or curved mirror which collimates the light from the reticule making it nearly parallel with the axis of device or gun barrel. Reticules may include battery powered lights, fiber optic light collectors, and tritium capsules. Reflector sights incorporating curved mirrors and powered reticules can be fairly bulky.

Furthermore, the aforementioned types of sights may also be adapted for use with launching devices. For instance, the leaf sight is an iron sight attached to the top of a gun's handguard and cooperates with the front sight post of the gun. It comprises a folding, adjustable, open ladder design which may include elevation adjustments positioned along the ladder at 50 meter increments. This type of sight allows for quick adjustment to different elevations or distances without having to readjust the sight. However, this type of sight protrudes from the top of the gun, increasing the guns profile and making it easier for it to be broken off.

Another adjustable sight is the pivoting sight mount. This type of sight is generally mounted to the side of a gun that has an attached grenade launcher. It mounts to the side because the gun usually already has a sight for the gun portion. This type of sight arrangement increases the parallax created by placing the sight off to the side of the center of the barrel. Additionally, if multiple users of different handedness are using the weapon, the users will have to dismount and reassemble the sight to the other side of the weapon. Further, the pivoting side mount may be unable to mount to certain weapons, for example, a revolver-type grenade launcher like the Milkor MGL-140 (a.k.a. the M32), and it also adds another piece of equipment to an already large handheld weapon.

SUMMARY OF THE INVENTION

The present invention relates to sighting equipment, particularly a sight that is lightweight, compact, easily adjustable, and provides improved aiming characteristics. It may be mounted to the top of the weapon, making it capable of being utilized as a point-of-aim weapon/launcher sight for a primary targeting system as well as providing an elevation adjustable sighting system for compensation of elevation related ballistics ranging adjustments required by a projectile launching device.

One aspect of the invention provides a sight for a weapon, the sight having a mount having a mount first end portion and a mount second end portion opposite the mount first end portion; a sight assembly including a body, the body having a body first end portion, a body second end portion opposite the body first end portion, and a body bottom surface extending between the body first end portion and the body second end portion; wherein the body first end portion is pivotally mounted at or near the mount first end portion; and a launch angle adjustment mechanism having an upstanding member extending upward from the mount second end portion and a setting assembly affixed to the body bottom surface at or near the body second end portion, operatively connecting the mount second end portion and the body second end portion and configured to adjust and set a predetermined launch angle.

The sight may also have a light source assembly including a transparent dome and a reticule supported within the dome.

The launch angle adjustment mechanism may have a track within the upstanding end, the track having a length and a plurality of notches along the length on at least one side of the track, whereby each notch represents a predetermined target distance; and wherein the setting assembly includes an engagement member engageable with the plurality of notches. The plurality of notches may be non-linearly spaced.

The launch angle adjustment mechanism may have a track within the upstanding member, the track having a length and a plurality of notches along the length of the track on at least one side of the track, whereby each notch represents a predetermined target distance; and wherein the setting assembly includes a knob having a distal end, a proximal end, and an engagement surface of increasing diameter from the proximal end to the distal end; the knob configured to move inwards and outwards perpendicular to the length of the track whereby the engagement surface interfaces with the plurality of notches. The plurality of notches may be non-linearly spaced.

The launch angle adjustment mechanism may have a track within the upstanding member, the track having a length and a plurality of teeth along the length of the track on at least one side of the track; a plurality of detent recesses in the upstanding member next to and along the length of the track, whereby each detent recess represents a predetermined target distance; wherein the setting assembly includes a detent wheel affixed to a gear wheel, the detent wheel having a first detent wheel surface and a second detent wheel surface opposite the first detent wheel surface, a plurality of substantially cylindrical detent pockets spaced near and around the periphery of the detent wheel extending from the first detent wheel surface through the second detent wheel surface where, a plurality of detent balls and detent springs placed within the detent pockets, the diameter of the detent pocket at the second detent wheel surface being smaller than the detent ball diameter, and a plurality of detent caps to contain the detent balls and the detent springs within the detent pockets; and the gear wheel interfacing with the track and the plurality of detent balls of the detent wheel engaging with the plurality of detent recesses. One detent ball may be designated for a specific detent recess.

The launch angle adjustment mechanism may have a track within the upstanding member, the track having a length; a plurality of cavities in the upstanding member next to and along the length of the track, whereby each cavity represents a predetermined target distance; and wherein the setting assembly includes a biased pull-button extending through the track, the pull-button having a protrusion configured to fit within one of the plurality of cavities. The plurality of cavities may be non-linearly spaced.

The launch angle adjustment mechanism may have a track within the upstanding member, the track having a length; a plurality of grooves; wherein the setting assembly includes a biased push-button comprising a projecting member; and whereby the projecting member is selectively receivable within the plurality of grooves.

The plurality of grooves may be positioned on the exterior surface of the upstanding member, adjacent to one side of the track and for substantially the track length, whereby each groove represents a predetermined target distance.

The plurality of grooves may be positioned on along the interior of the track for substantially the track length, whereby each groove represents a predetermined target distance.

The plurality of grooves may be non-linearly spaced.

Another aspect of the invention provides a sight for a weapon, the sight having a mount having a mount first end portion and a mount second end portion opposite the mount first end portion, the mount configured to be removably attached to the weapon; a sight assembly comprising a body, the body having a body first end portion, a body second end portion opposite the body first end portion, and a body bottom surface and wherein the body first end portion is pivotally mounted at or near the mount first end portion; a launch angle adjustment mechanism having a first upstanding member and a second upstanding member extending upward from the mount at or near the mount second end portion opposite one another, and a setting assembly; the first upstanding member including a first upstanding member track with a first upstanding member track length; the second upstanding member including a second upstanding member track with a second upstanding member track length; and the setting assembly affixed at or near the body second end portion and interfacing with the first upstanding member track and the second upstanding member track, and configured to adjust and set a predetermined launch angle.

The body may have a light source assembly including a transparent dome and a reticule supported within the dome.

The sight may have a plurality of notches spaced along the first upstanding member track length on at least one side of the first upstanding member track, a plurality of notches spaced along the second upstanding member track length on at least one side of the second upstanding member track, the first track notches being aligned with the second track notches, and the setting assembly comprising an engagement member biased towards the plurality of notches in the first and second upstanding member tracks.

The first upstanding member notches may correspond to a first set of target distances and the second upstanding member notches may correspond to a second set of target distances.

At a launch angle greater than zero, the first upstanding member notches may not correspond to the same target distance as the corresponding second upstanding member notches.

The setting assembly may have a first selectively disengageable setting assembly interfacing with the first upstanding member and a second selectively disengageable setting assembly interfacing with the second upstanding member.

BRIEF DESCRIPTION OF THE DRAWINGS

FIG. 6A is a side view of the adjustable launch angle sight of FIG. 1 in a first position.

FIG. 6B is a close-up view of the adjustable launch angle sight of FIG. 6A.

FIG. 7A is a side view of the adjustable launch angle sight of FIG. 1 in a second position.

FIG. 7B is a close-up view of the adjustable launch angle sight of FIG. 7A.

FIG. 8A is a side view of the adjustable launch angle sight of FIG. 1 in a third position.

FIG. 8B is a close-up view of the adjustable launch angle sight of FIG. 8A.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
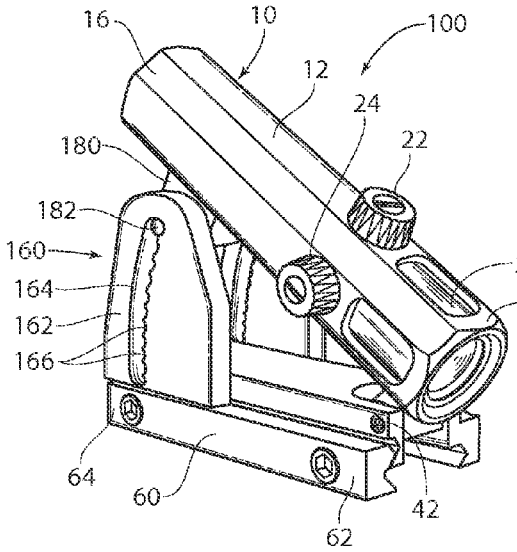
FIG. 1 is a perspective view of an adjustable launch angle sight according to the present invention.
Figure 2:
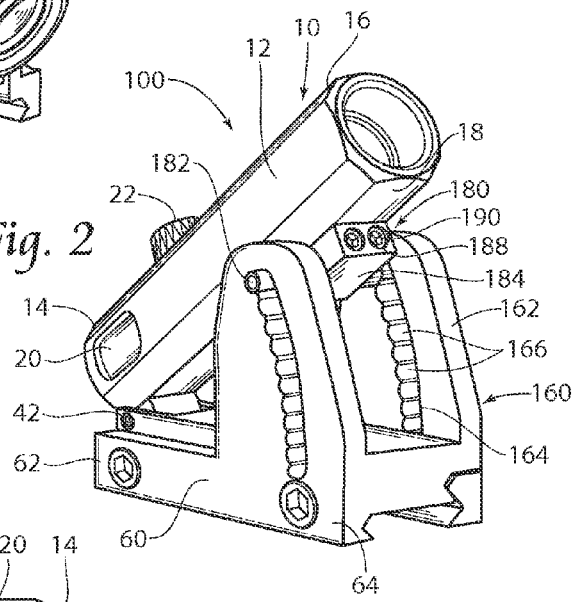
FIG. 2 is a perspective view of the adjustable launch angle sight of FIG. 1, rotated 180 degrees.
Figure 3:
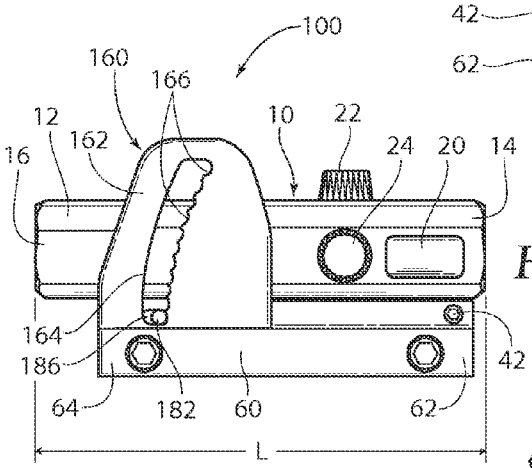
FIG. 3 is a side elevation view of the adjustable launch angle sight of FIG. 1 in a first position.
Figure 4:
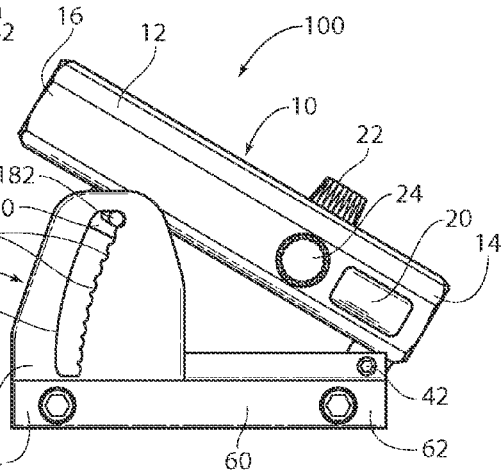
FIG. 4 is a side elevation view of the adjustable launch angle sight of FIG. 1 in a second position.

FIG. 1 illustrates a preferred first embodiment 100 of an adjustable launch angle sight according to the present invention. As will be described in further detail below, the adjustable launch angle sight 100 provides a more versatile sighting device compared to prior art devices. The adjustable launch angle sight 100 preferably comprises a sight assembly 10, a mount 60, a pivot mechanism 42, and a means for adjusting and setting a launch angle depending on a target distance (here shown as a first embodiment 160 of a launch angle adjustment mechanism).

Figure 5:
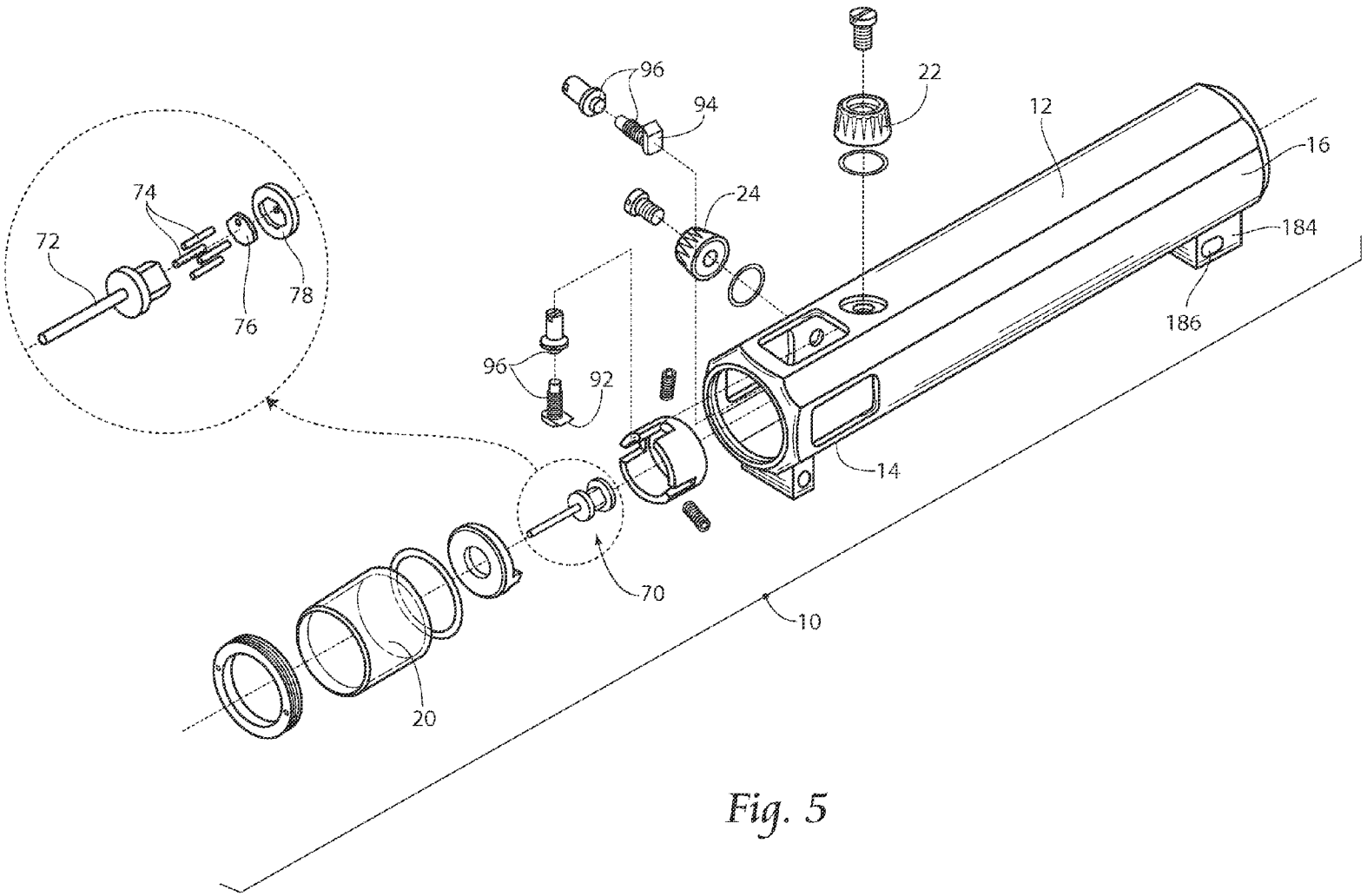
FIG. 5 is an exploded view of a sight body according to the present invention.

As shown in FIGS. 1-4, the sight assembly 10 preferably comprises a body 12 having a body first end portion 14, a body second end portion 16, a body bottom surface 16 (see FIG. 2), and a body length L (see FIG. 3); a transparent dome 20; a windage adjustment knob 22; an elevation adjustment knob 24; and a light source assembly 70 within the body 12 (hidden but shown in FIG. 5).

Figure 16A:
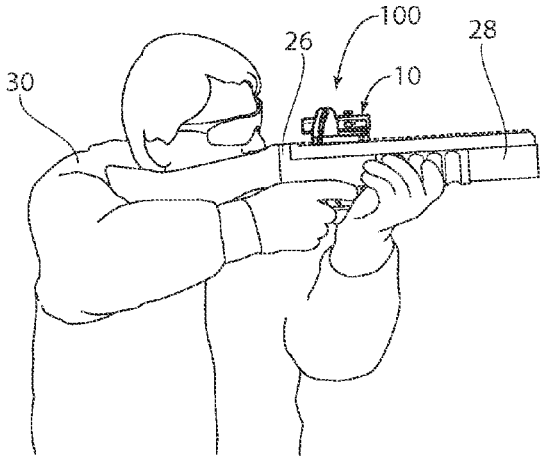
FIG. 16A is an illustration of the adjustable launch angle sight of FIG. 1 installed on a weapon and configured in a first position.

The mount 60, having a mount first end portion 62 and a mount second end portion 64 opposite the mount first portion 62, is preferably configured to attach the adjustable launch angle sight 100 to a scope mount of a projectile firing device like the launcher weapon 26 shown in FIG. 16A, but it is within the purview of the present invention to provide other mounts 14 configured to attach to other types of scope mounts.

The first embodiment 160 of the launch angle adjustment mechanism comprises at least one upstanding member 162, with a track 164, extending upward from the mount 60, and a biasing system 180 attached to the body 12 on the body bottom surface 18 at or near the body second portion 16.

The biasing system 180 comprises an engagement member 182, a housing 184 having at least one housing slot 186 (see FIG. 5), at least one access opening 188, at least one access opening cap 190, and at least one biasing member (hidden). The engagement member 182 is preferably partially contained within the housing 184 and extends through the at least one housing slot 186 and into the track 164. As shown here, the track 164 has notches 166 along one side. The biasing member (hidden) preferably provides a biasing force parallel with the body length L between the engagement member 182 and the at least one access opening cap 190. The engagement member 182 is preferably sized and configured to be biased towards, and received within, one of the notches 166.

The pivot mechanism 42 is placed at or near the body first end portion 14 and rotatably attaches the sight assembly 10 to the mount 60 at or near the mount first end portion 62.

FIG. 5 illustrates an exploded view of the sight assembly 10. Here, the housing slots 186 of the housing 184 may be viewed without obstruction. The light source assembly 70 is also shown in greater detail and comprises a light source 72, at least one tritium lamp 74, a reticule 76, and a reticule holder 78. The light source 72 is positioned within the dome 20 to be exposed to ambient light and is used to illuminate the reticule. Additionally, as shown here, a self-luminous material such as the at least one tritium lamp 74 may be used to illuminate the reticule 76. This may be advantageous in low light situations; however, the at least one tritium lamp 74 should not be construed as being an essential element of the sight assembly 10 as an externally powered light source may be used in conjunction with or in place of the light source 72 or the at least one tritium lamp 74. A non-limiting example would be a light emitting diode or a laser. The reticule 76 may comprise a "red dot" style dot or "picket post," as non-limiting examples.

Windage and elevation adjustment knobs 22, 24, respectively, are also shown in FIG. 5. Each knob 22, 24 is in mechanical communication with an adjuster pushrod 92, 94, respectively. As the knobs 22, 24 are rotated, the rotational movement is translated to linear movement of the adjuster pushrods 92, 94 by way of interfacing threads 96.

The linear movements of the adjuster pushrods 92, 94 transfer to the light source assembly 70 to move the light source assembly 70 left and right and up and down. The interface of the windage pushrod 92 and the light source assembly 70 allows the windage adjustment knob 22 to move the light source assembly 70 side to side. The interface between the elevation pushrod 94 and the light source assembly 70 allows the elevation adjustment knob 24 to move the light source assembly 70 up and down.

The adjustment of the adjustable launch angle sight 100 is illustrated in FIGS. 6A-6B. Preferably, the sight assembly 10 may be adjusted relative to the mount 60 to place an aiming dot/post/circle/or reticule 76 (FIG. 5) on a target, with the weapon 26 (see FIGS. 16A and 16B) positioned at an angle which allows for the most accurate (predetermined and/or interpolated) placement of the projectile at the target site.

As shown in FIGS. 6A and 6B, the biased member 182 is biased towards and received within a notch 166*a* at the bottom of the track 164. The position of the sight assembly 10 parallel to the barrel 28 or 34 (see FIGS. 16A and 17) may be preferable if a projectile target is fairly close, for example within 10 meters, or if firing a gun element in which no launch angle is desired.

However, if using the adjustable launch angle sight 100 with a projectile launching weapon 26 (see FIG. 16B) for striking a target at a longer distance, a launch angle greater than zero is likely desired.

In FIGS. 7A and 7B, the sight assembly 10 is moved from the parallel position shown in FIGS. 6A and 6B along the track 164 by applying an upward force depicted by arrow A, the biasing force of the biasing system 180 retaining the engagement member 182 within the notch 166*a* is overcome and the engagement member 182 exits the notch 166*a*. The sight assembly 10 rotates about the pivot 42 until the preferred launch angle of the sight assembly 10 is achieved, shown here in FIGS. 8A and 8B as the upper-most notch 166. Conversely, the process may be reversed to lower the sight 10. The engagement member 182 may provide audible and tactile feed back as it traverses the track 164 as it enters and exits each notch 166.

Additionally, or alternatively, the engagement member 182 may be manually withdrawn from the notches 166 by pulling the engagement member 182 against the biasing force of the biasing member (not shown). This may be preferred if no tactile feedback or sound is desired during launch angle adjustment.

Generally, different projectiles travel through the air at different rates depending on shape and ejection speed, thus altering the ratio of launch angle to target distance. Therefore, it is contemplated that the adjustable launch angle sight 100 may be calibrated for a specific type of projectile/launcher combination and may include a series of pre-indexed slots, stops, or notches 166. For example, a notch 166 designating 100 meters for a 37 mm round may correlate to the proper notch 166 for launching a 40 mm round 250 meters.

Figure 9A:
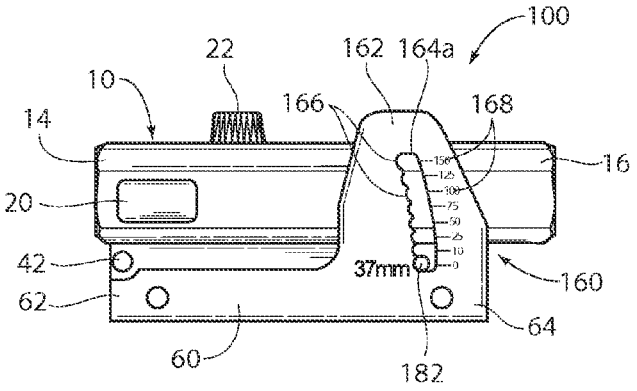
FIGS. 9A and 9B are two side views of the adjustable launch angle sight of FIG. 1.
Figure 9B:
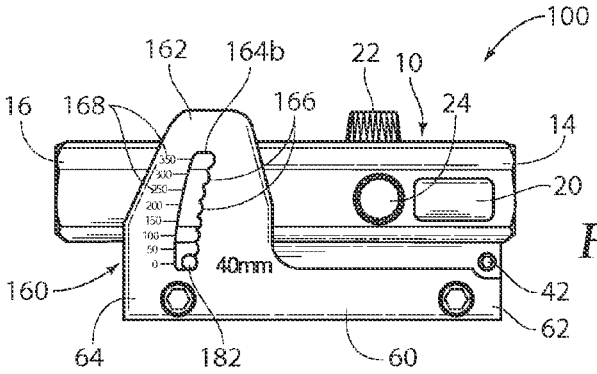

FIGS. 9A and 9B illustrate the adjustable launch angle sight 100 with two upstanding members 162, each for use with a different type of projectile. 0. Each upstanding member 162 comprises a track 164*a* and 164*b*, respectively, a plurality of notches 166, and indicia 168 associated with the plurality of notches 166 designating projectile launching distances. Here, FIG. 9A illustrates one upstanding member 162 as designated for use with a 37 mm projectile and FIG. 9B illustrates an upstanding member 162 for use with a 40 mm projectile. The notches 166 of the track 164*a* in FIG. 9A designate shorter projectile launching distances than the corresponding notches 166*b* of the track 164 in FIG. 9B as the two types of projectiles have different flight characteristics. It should be noted that other combinations of rounds are contemplated by the present invention.

Figure 10:
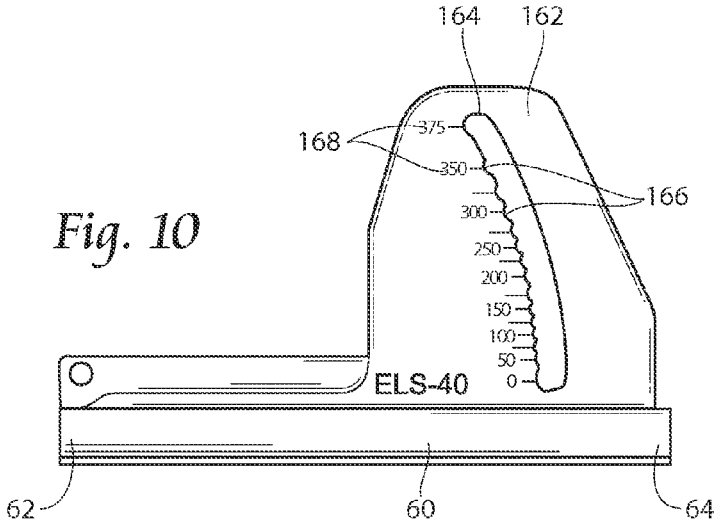
FIG. 10 is a side elevation view of a notched track according to the present invention.

Furthermore, depending on the type of projectile being fired, a change in target distance may not always correlate to a consistent linear distance between the notches 166 along the track 164. Therefore, a non-linear distance between notches 166 may be preferable. As shown in FIG. 10, with respect to a 40 mm round, a change in target distance within a closer range, for instance from 50 meters to 100 meters, requires only a minimal adjustment of weapon angle. However, a change in target distance within a farther range, for instance from 350 meters to 375 meters, requires a more substantial adjustment of weapon angle for a smaller increase in target distance.

Additionally or alternatively, as depicted in FIGS. 11-15C, the means for adjusting and setting a launch angle may comprise a friction stop 260, a detent wheel 360, or a biased pull-button interface 460, or a biased push-button 560, 660 as non-limiting examples.

Figure 11:
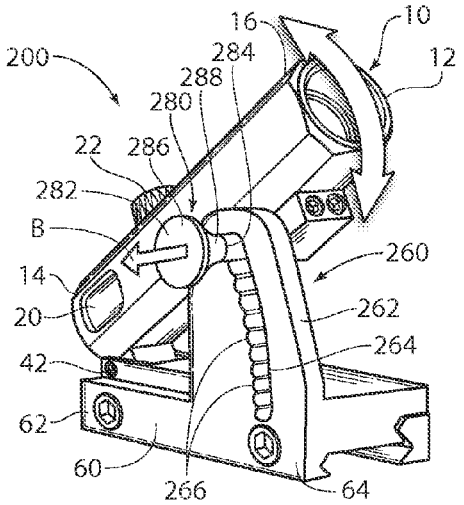
FIG. 11 is a perspective view of a second embodiment of an adjustable launch angle sight according to the present invention.

FIG. 11 illustrates a second embodiment 200 of the adjustable launch angle sight. The second. embodiment 200 comprises a friction stop launch angle adjustment mechanism 260 as the means for adjusting and setting a launch angle. The friction stop launch angle adjustment mechanism 260 comprises at least one upstanding member 262, having a track 264 with notches 266 and extending upward from the mount 60 at or near the mount second end portion 64, and a setting assembly 280 comprising a sliding knob 282 preferably operatively connected to the body 12 and at least partially received within the track 264. The knob 262 comprises a proximal end 284, a distal end 286, and an engagement surface 288. The engagement surface 288 increases in diameter from the knob proximal end 284 to the knob distal end 286.

Thus, the knob 282 may be pulled outward in the direction of the arrow to disengage the larger diameter of the engagement surface 288 from a notch 266 to permit travel along the track 264. The knob may then be pushed back in to interface with another notch 266 to secure the sight 10 in position. Retention of the knob 282 within a notch 266 by accomplished in any preferred manner. For example, the knob 282 may be biased towards the body 12 or the knob 282 may be retained by friction between the engagement surface 288 and a notch 266.

Figure 12A:
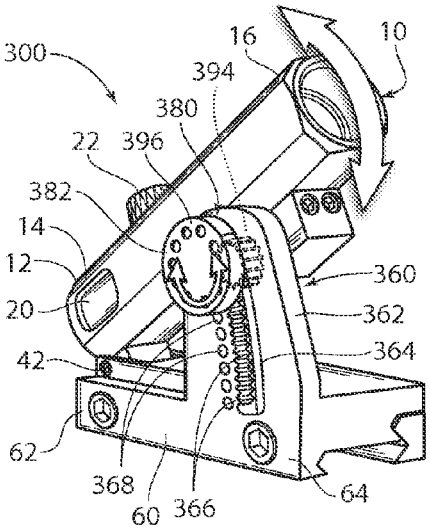
FIG. 12A is a perspective view of a third embodiment of an adjustable launch angle sight according to the present invention.
Figure 12B:
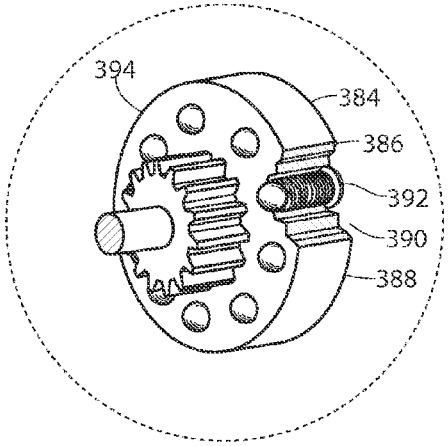
FIG. 12B is a reversed partial cut-away view of a detent wheel assembly of the adjustable launch angle sight of FIG. 12A according to the present invention.

FIG. 12A depicts a third embodiment 300 of the adjustable launch angle sight. The third embodiment 300 comprises a detent wheel launch angle adjust mechanism 360 as the means for adjusting and setting a launch angle. The detent wheel launch angle adjustment mechanism 360 comprises at least one upstanding member 362 extending upward from the mount 60 at or near the mount second end portion 64, and a setting assembly, here a detent wheel assembly 380. The upstanding member 362 comprises a track 364 with teeth 366 and a plurality of detent recesses 368 along the outside of the track 364.

The detent wheel assembly 380 is operatively connected to the body 12 and the track 364. The detent wheel assembly 380, shown in greater detail in FIG. 12B, comprises a detent wheel 382 with detent pockets 386 near the periphery of the surface of the detent wheel 382, detent balls 388 and detent springs 390 received within the detent pockets 386, detent caps 392 to retain the detent balls 398 and the detent springs 390 within the detent pockets 386, and a gear wheel 394. The diameter of the detent pockets 386 at the side of the detent wheel 382 closet to the upstanding member 362 being preferably smaller than the diameter of the detent balls 388 to retain the detent balls 388 within the detent pockets 386. The detent caps 392 may be plugs, screws, or the like. The gear wheel 394 intermeshes with the teeth 366 of the track 364 and the detent balls 388 interface with the detent recesses 368.

The angle of the sight assembly 10 is changed by rotating the detent wheel 382, which rotates the gear wheel 394 along the track 364. It is contemplated that one detent ball 388 will correspond to only one detent recess 368 thus allowing for the spacing between detent balls 388 (and effectively detent recesses 368) to be variable. Therefore, one rotation or less of the detent wheel 382 will cover the entire length of the track 364. This is preferable in situations as discussed above in which a change in target distance is not linearly related to a change in projectile launch angle.

It is also contemplated that the placement of the detent wheel assembly 380 be configured to be locked into place. This may be achieved by including a selectively engageable pawl arm (not shown) operatively attached to the detent wheel assembly 380 to engage with the track teeth 366 directly or part of a coincident assembly of pawl arm and pawl wheel (not shown) which may selectively engageable and configured to rotate simultaneously with the detent wheel. Alternative methods of locking known to those in the art are also considered within the purview of the present invention.

Figure 13:
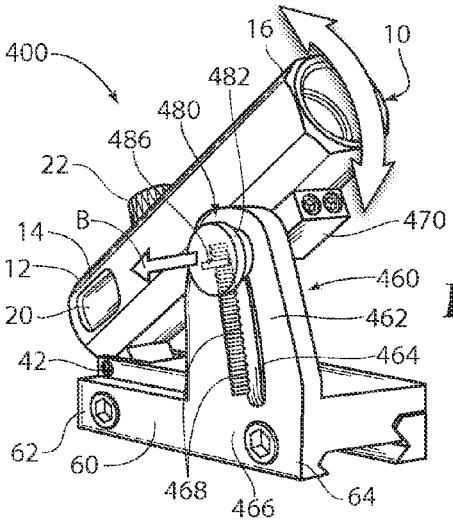
FIG. 13 is a perspective view of a fourth embodiment of an adjustable launch angle sight according to the present invention.

FIG. 13 depicts a fourth embodiment 400 of the adjustable launch angle sight. The fourth embodiment 400 comprises a pull-button stop launch angle adjustment mechanism 460 as the means for adjusting and setting a launch angle. The pull-button launch angle adjustment mechanism 460 comprises at least one upstanding member 462 extending upward from the mount 60 at or near the mount second end portion 64 and a setting assembly, here a pull-button assembly 480.

The upstanding member 462 comprises a track 464 and a plurality of grooves 468 recessed into the upstanding member exterior surface 466 and positioned adjacent to and along the track 464.

The pull-button assembly 480 comprises a biased pull-button 482 operatively connected to the body 12 via a bias block 470 containing a biasing member (hidden). The biasing member (hidden) preferably provides a biasing force between the pull-button 482 and the body 12 in a similar fashion to the biasing system 180 discussed above, however, in a direction perpendicular to the body length L (see FIG. 3). The biased pull-button 482 preferably has a protrusion member 486 sized and configured to fit within the grooves 468.

The angle of the sight 10 is changed by pulling the pull-button 482 outward and away from the upstanding member 462, moving the pull-button assembly 480 along the track 464 to the desired distance setting, and releasing the pull-button 482 with the protrusion member 486 received by a groove 468. As previously discussed, the distances between the grooves may be varied if the characteristics of the weapon are such that a change in target distance is not linearly related to a change in projectile launch angle.

The protrusion member 486 may be configured to provide audible and tactile feed back as it traverses the cavities 468.

Additionally, or alternatively, the protrusion member 586 may be completely withdrawn from the grooves 568 by fully pulling the pull-button 582 outward. This may be preferred if no tactile feedback or sound is desired during launch angle adjustment.

Figure 14:
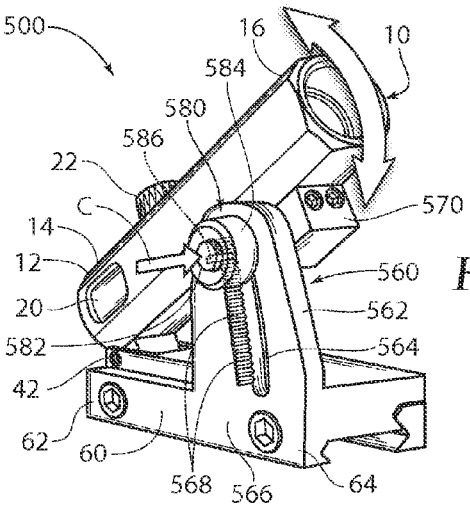
FIG. 14 is a perspective view of a fifth embodiment of an adjustable launch angle sight according to the present invention.

FIG. 14 illustrates a fifth embodiment 500 of the adjustable launch angle sight. The fifth embodiment 500 comprises a substantially external push-button launch angle adjustment mechanism 560 as the means for adjusting and setting a launch angle. The substantially external push-button launch angle adjustment mechanism 560 comprises at least one upstanding member 562 extending upward from the mount 60 at or near the mount second end portion 64 and a setting assembly, here a substantially external push-button assembly 580.

The upstanding member 562 comprises a track 564 and a plurality of grooves 568, similar to the grooves 468 discussed above, recessed into the upstanding member exterior surface 566 and positioned adjacent to and along track 564.

The push-button assembly 580 comprises a biased push-button 582, a push-button housing 584, and a projecting member 586. The push-button assembly 580 is operatively connected to the body 12 via a bias block 570 containing a biasing member (hidden). The biasing member (hidden) preferably provides a biasing force between the push-button 582 and the body 12 in a similar fashion to the biasing system 180 discussed above, however, in a direction perpendicular to the body length L (see FIG. 3). The projecting member 586 is preferably sized and configured to fit within and be biased towards the grooves 568.

The angle of the sight 10 is changed first by pushing the push-button 582 inward and towards the upstanding member 562, thereby disengaging/retracting the projecting member 586 from one of the grooves 586. The pushing/disengaging action is similar to the disengaging action of a push-button aircraft locking pin or other type of ball-lock pin, however, where the release action of the projecting member 586 is in the opposite direction of the pushing action, here designated by arrow C. It is also contemplated that the projecting member 586 be sized and configured in a mostly v-shape of substantially the same dimensions as the grooves 568.

After the push-button 582 is depressed and the projecting member is at least substantially disengaged, the push-button assembly 580 may be moved along the track 564 to the desired distance setting. Then the push-button 582 may be released and the projecting member 586 will be received by a groove 568. As previously discussed, the distances between the grooves 566 may be varied if the characteristics of the weapon are such that a change in target distance is not linearly related to a change in projectile launch angle.

The projecting member 586 may also be configured to provide audible and tactile feed back as it traverses the grooves 568.

Additionally, or alternatively, the projecting member 586 may be completely withdrawn from the grooves 568 by fully depressing the push-button 582. This may be preferred if no tactile feedback or sound is desired during launch angle adjustment.

Figure 15A:
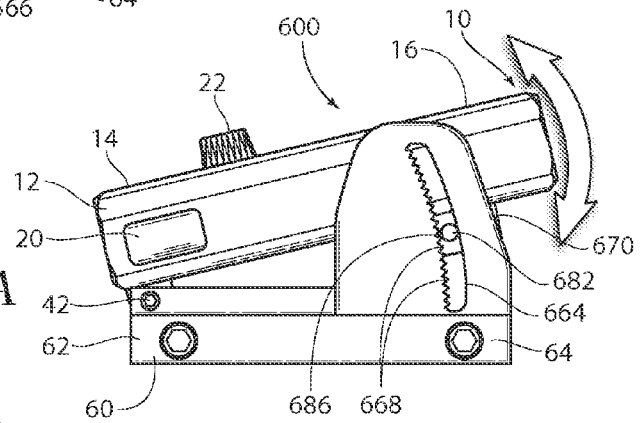
FIG. 15A is a perspective view of a sixth embodiment of an adjustable launch angle sight according to the present invention.
Figure 15B:
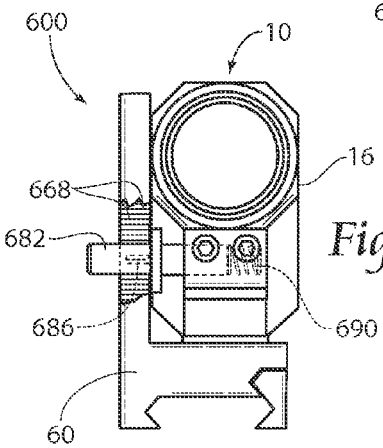
FIGS. 15B and 15C are partial cut-away rear elevation views of the adjustable launch angle sight of FIG. 15A.
Figure 15C:
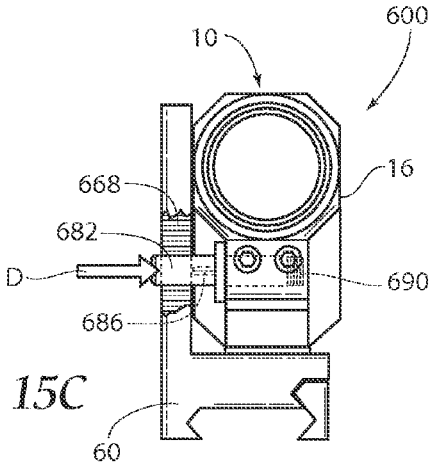

A sixth embodiment 600 of the adjustable launch angle sight is shown in FIGS. 15A-C. The sixth embodiment 600 comprises a substantially internal push-button launch angle adjustment mechanism 660 as the means for adjusting and setting a launch angle. The substantially internal bush-button launch angle adjustment mechanism 660 comprises at least one upstanding member 662 extending upward from the mount 60 at or near the mount second end portion 64 and a setting assembly, here a substantially internal push-button assembly 680.

The upstanding member 662 comprises a track 664 and a plurality of grooves 668. As shown in FIGS. 15A-C, the grooves 668 are positioned within and along one side of the track 664 and a projecting member 686 is directly affixed or a part of the push-button 682, similar to the pull-button 480 described above. However, notches (not shown her), similar to those of the first embodiment 100, may be employed alternatively.

The push-button assembly 680 is operatively connected to the body 12 via a bias block 670 containing a biasing member 690. As shown here the assembly 680 may be substantially positioned under the body 12 and within the track 664.

When the push button 682 is in a normally biased position (see FIG. 15B) the projecting member 686 is positioned within the grooves 668. As the push-button 682 is depressed (see FIG. 15C) in the direction of arrow D, the projecting member 686 is removed from the grooves 668, thus allowing adjustment of the sight launch angle. After the sight 10 is moved to the predetermined position, the push-button 682 is released, the biasing member 690 forces the push-button 682 in the direction opposite arrow D, and the projecting member 686 is once again seated as shown in FIG. 15B.

It is further contemplated that the pull-button launch angle adjustment mechanism 460 and the external push-button launch angle adjustment mechanisms 560, 660 which incorporate grooves 468, 568, 668, respectively, may also comprise a follower (not shown) to engage the grooves 468, 568, 668 when the sight is in the preferred launch angle. The follower (not shown) may be biased against the grooves 468, 568, 668, manually employed by an operator 30 (FIG. 16A), or selectively biased. If biased, the follower (not shown) may provide tactile feedback and/or sound as the sight 10 is changing position.

Additionally or alternatively, the alternative launch angle adjustment mechanism embodiments 260, 360, 460, 560, and 660 may be employed on dual-projectile sights similar to that shown in FIGS. 9A and 9B, wherein each upstanding member 262, 362, 462, 562, 662 interfaces with an independent selectively engageable setting assembly 280, 380, 480, 580, 680. The setting assemblies 280, 380, 480, 580 being selectively disengageable by pulling the knob 282, the detent wheel 382, the pull-button 482, or the substantially external push-button 582, respectively, outward past a click-stop (not shown) to disengage from the corresponding notches 266, detent recesses 368, and grooves 468, 568, respectively, or, in the case of the substantially internal push-button assembly 580, pushing the substantially internal push-button 682 inward past a click-stop (not shown) to disengage the projecting member 686 from the grooves 668 of the track 664.

Figure 16B:
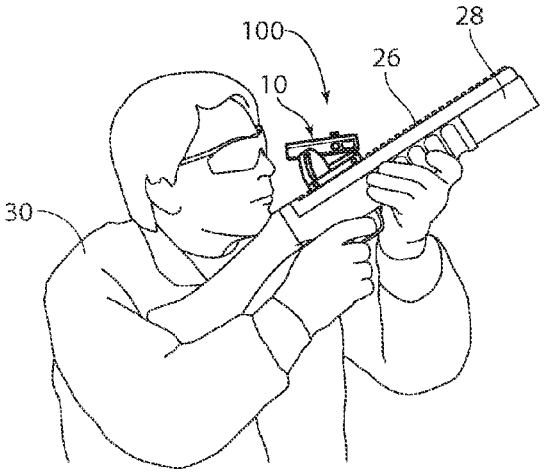
FIG. 16B is an illustration of the adjustable launch angle sight of FIG. 16A configured in a second position.

FIGS. 16A and 16B further illustrate how the adjustable launch angle sight 100 may be used at a zero launch angle and at a launch angle greater than zero, respectively. The adjustable launch angle sight 100 is preferably mounted to the top of a weapon 26. When in use, an operator 30 keeps both eyes open, whereby one eye is directly behind, and looking into the sight assembly 10 and the other is looking at a target downrange (not shown). For example, for a right-handed shooter, the shooter's right eye would be behind the sight assembly 10 and the shooter's left eye would be looking at the target.

The sight assembly 10 is generally blackened, with the reticule 76 being the only visible element within the sight assembly 10. Therefore, when the operator 30 looks into the sight assembly 10, only the reticule 76 is visible in the center of the blackened out sight assembly 10. Due to the brain's ability to blend or overlap images seen through the right eye with images seen through the left eye when both eyes are open, the operator 30 will see the reticule 76 as seen with the right eye overlap the target as seen through the left eye. Additionally, by keeping both eyes open, neither the operator's peripheral vision nor depth perception is impaired. Therefore, when a launch angle greater than zero is required, the fact that the barrel 28 is blocking front of the sight assembly 10 does not matter.

Figure 17:
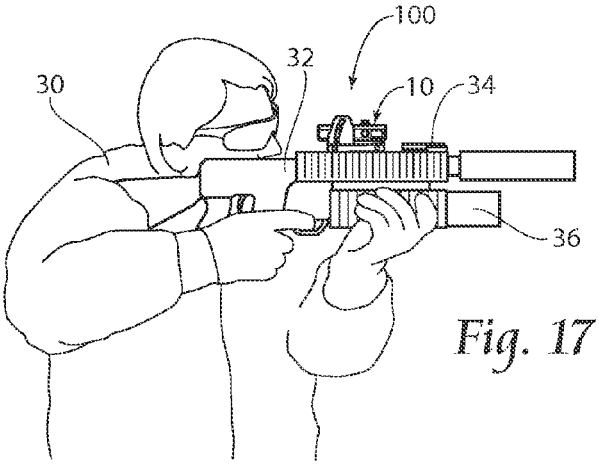
FIG. 17 is an illustration of the adjustable launch angle sight of FIG. 1 installed on a weapon comprising a gun and a projectile launcher.

A weapon 32 having a gun element 34 and a launcher element 36 is shown in FIG. 17. Here, the adjustable launch angle sight 100 may be used with either the gun element 34 or the launcher element 36 because it is mounted on the top, or twelve o'clock position, of the weapon 32. The placement of the adjustable launch angle sight 100 on the top of the weapon 32, along with its low profile, provides improvements in aiming characteristics, including reduced/eliminated induced parallax because the shooter's dominant eye is above the barrel of both the gun element 34 and the launcher element 36, instead of to the side. Moreover, the low profile of the adjustable launch angle sight 100 brings the sight axis closer to the axis of the gun element 34 and the launcher element 36. Therefore, the adjustable launch angle sight 100 may be used as a point-of-aim weapon/launcher sight for a primary targeting system.

Additionally or alternatively, the mount 60 may be universal to different weapons. Because of the position of the adjustable launch angle sight 100 on a weapon, it may be used as the primary sight in a multitude of different weapons, from rifles to multiple shot grenade launchers. This adaptability also promotes quicker training times because after learning how to use the adjustable launch angle sight 100 on one type of weapon, a person no longer has to learn the sighting equipment on any other weapon employing the adjustable launch angle sight 100.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. An occluded sight for a weapon, the occluded sight comprising:

a mount having a mount first end portion and a mount second end portion opposite the mount first end portion;

an occluded sight assembly including a body, the body having a body first end portion, a body second end portion opposite the body first end portion, and a body bottom surface extending between the body first end portion and the body second end portion;

wherein the body first end portion is pivotally mounted at or near the mount first end portion and an image viewed through the sight assembly is substantially blackened; and a launch angle adjustment mechanism having an upstanding member extending upward from the mount second end portion and a setting assembly affixed to the body bottom surface at or near the body second end portion, operatively connecting the mount second end portion and the body second end portion and configured to adjust between a first position wherein the body is substantially parallel to a barrel of the weapon and a second position wherein the barrel of the weapon substantially obstructs a line of sight of the sight assembly to set a predetermined launch angle.

2. The occluded sight of claim 1, wherein the launch angle adjustment mechanism further comprises a light source assembly including a transparent dome and a reticle support within the dome.

3. The occluded sight of claim 1, wherein the launch angle adjustment mechanism further comprises:

a track within the upstanding end, the track having a length and a plurality of notches along the length on at least one side of the track, whereby each notch represents a predetermined target distance; and wherein the setting assembly includes an engagement member engageable with the plurality of notches.

4. The occluded sight of claim 3, wherein the plurality of notches are non-linearly spaced.

5. The occluded sight of claim 1, wherein the launch angle adjustment mechanism comprises:

a track within the upstanding member, the track having a length and a plurality of notches along a length of the track on at least one side of the track, whereby each notch represents a predetermined target distance; and wherein the setting assembly includes a knob having a distal end, a proximal end, and an engagement surface of increasing diameter from the proximal end to the distal end; the knob configured to move inwards and outwards perpendicular to the length of the track whereby the engagement surface interfaces with the plurality of notches.

6. The occluded sight of claim 5, wherein the plurality of notches are non-linearly spaced.

7. The occluded sight of claim 1, wherein the launch angle adjustment mechanism further comprises:

a track within the upstanding member, the track having a length and a plurality of teeth along the length of the track on at least one side of the track;

a plurality of detent recesses in the upstanding member next to and along the length of the track, whereby each detent recess represents a predetermined target distance;

wherein the setting assembly includes a detent wheel affixed to a gear wheel, the detent wheel having a first detent wheel surface and a second detent wheel surface, a plurality of substantially cylindrical detent pockets spaced near and around the periphery of the detent wheel extending from the first detent wheel surface through the second detent wheel surface where, a plurality of detent balls and detent springs placed within the detent pockets, the diameter of the detent pocket at the second detent wheel surface being smaller than the detent ball diameter, and a plurality of detent caps to contain the detent balls and the detent springs within the detent pockets; and the gear wheel interfacing with the track and the plurality of detent balls of the detent wheel engaging with the plurality of detent recesses.

8. The occluded sight of claim 7, wherein one detent ball is designated for a specific detent recess.

9. The occluded sight of claim 1, wherein the launch angle adjustment mechanism further comprises:

a track within the upstanding member, the track having a length;

a plurality of cavities in the upstanding member next to and along the length of the track, whereby each cavity represents a predetermined target distance; and wherein the setting assembly includes a biased pull-button having a protrusion configured to fit within one of the plurality of cavities.

10. The occluded sight of claim 1, wherein the launch angle adjustment mechanism further comprises:

a track within the upstanding member, the track having a length;

a plurality of grooves;

wherein the setting assembly includes a biased push-button comprising a projecting member; and whereby the projecting member is selectively receivable within the plurality of grooves.

11. The occluded sight of claim 10, wherein the plurality of cavities are non-linearly spaced.

12. The occluded sight of claim 10, wherein the plurality of grooves are positioned on the exterior surface of the upstanding member, adjacent to one side of the track and for substantially the track length, whereby each groove represents a predetermined target distance.

13. The occluded sight of claim 10, wherein the plurality of grooves are positioned along the interior of the rack for substantially the track length, whereby each groove represents a predetermined target distance.

14. The occluded sight of claim 10, wherein the plurality of grooves are non-linearly spaced.

15. A sight for a weapon, the sight comprising:

a mount having a mount first end portion and a mount second end portion, the mount configured to be removably attached to the weapon;

a sight assembly comprising a body, the body having a body first end portion, a body second end portion opposite the body first end portion, and a body bottom surface and wherein the body first end portion is pivotally mounted at or near the mount first end portion;

a launch angle adjustment mechanism having a first upstanding member and a second upstanding member extending upward from the mount at or near the mount second end portion opposite one another, and a setting assembly;

the first upstanding member including a first upstanding member track with a first upstanding member track length;

the second upstanding member including a second upstanding member track with a second upstanding member track length; and the setting assembly affixed at or near the body second end portion and interfacing with the first upstanding member track and the second upstanding member track, and configured to adjust and set a predetermined launch angle;

wherein the plurality of notches are spaced along the first upstanding member track length on at least one side of the first upstanding member track, a plurality of notches are spaced along the second upstanding member track length on at least one side of the second upstanding member track, the first track notches being aligned with the second track notches, and the setting assembly comprising an engagement member biased towards the plurality of notches in the first and second upstanding member tracks; and wherein the first upstanding member notches correspond to a first set of target distances and the second upstanding member notches correspond to a second set of target distances.

16. The sight of claim 15, wherein the body comprises a light source assembly including a transparent dome and a reticle supported within the dome.

17. The sight of claim 15, wherein at a launch angle greater than zero, the first upstanding member notches do not correspond to the same target distance as the corresponding second upstanding member notches.

18. The sight of claim 15, wherein the setting assembly comprises a first selectively disengageable setting assembly interfacing with the first upstanding member and a second selectively disengageable setting assembly interfacing with the second upstanding member.

* * * * *